United States Patent [19]

Laskaris

[11] Patent Number: 4,614,393

[45] Date of Patent: Sep. 30, 1986

[54] RETRACTABLE LEAD SYSTEM FOR OPERATION AT CRYOGENIC TEMPERATURES

[75] Inventor: Evangelos T. Laskaris, Schenectady, N.Y.

[73] Assignee: General Electric Company, Schenectady, N.Y.

[21] Appl. No.: 621,330

[22] Filed: Jun. 15, 1984

[51] Int. Cl.[4] ..... H01R 4/24

[52] U.S. Cl. ..... 339/95 R; 339/239; 339/274; 339/278 C

[58] Field of Search ..... 339/239, 274, 278 C, 339/95 R

[56] References Cited

U.S. PATENT DOCUMENTS

| | | | |
|---|---|---|---|
| 1,861,451 | 6/1932 | Park | 339/239 |
| 1,904,241 | 4/1933 | Kammerer | 339/278 C |
| 1,936,469 | 11/1933 | Hill | 339/278 C |
| 2,864,071 | 12/1958 | Johnson, Jr. | 339/274 |
| 2,975,394 | 3/1961 | Peras | 339/239 |

*Primary Examiner*—Joseph H. McGlynn

*Attorney, Agent, or Firm*—Lawrence D. Cutter; James C. Davis, Jr.; Marvin Snyder

[57] ABSTRACT

A split ring clamp having a hard, serrated interior surface is urged against an electrically conductive lead by means of a pivoting cam lever. The conductive lead includes a metal coating which is relatively soft at cryogenic temperatures. This arrangement avoids the problem of frost buildup and undesirable resistive heating effects in the powering of superconducting electromagnets disposed within a cryostat, particularly a cryostat containing liquid helium as a cooling fluid.

16 Claims, 5 Drawing Figures

RETRACTABLE LEAD SYSTEM FOR OPERATION AT CRYOGENIC TEMPERATURES

BACKGROUND OF THE DISCLOSURE

The present invention relates to mechanical devices used for making secure electrical connections to superconductive coils disposed within cryostats. More particularly the present invention relates to exteriorly operated electrical connection mechanisms for use in superconductive magnets used in nuclear magnetic resonance (NMR) diagnostic medical imaging.

In the generation of tomographic and other images and data in medical NMR diagnostic systems, it is necessary to provide a highly uniform, high strength magnetic field. This field may be provided by permanent magnets, by conventional resistive magnets, or, by superconductive magnet structures. It is these latter superconductive structures which are of concern in the present invention. In these systems, main superconductive electrical coil windings are disposed in a vessel containing a cryogenic fluid such as liquid helium. The superconductive winding material is immersed in such a fluid so as to keep its temperature sufficiently low that the superconductive state is maintained. In order to provide the desired magnetic field uniformity, correction coils, similarly cryogenically disposed, are also employed. The main coils and the correction coils are disposed within a cryostat which is essentially a thermal insulation device. The superconductive windings exhibit the particular advantage that electrical energy need not be supplied to the circuit once the main coils and the correction coils are properly energized. However, in general, electrical connection must be made to these interior coil windings at various intervals. For example, in the case of a sudden magnetic quench condition in which the superconductive windings undergo a transition to the normal, resistive state, it is necessary to reconnect and re-energize the coils. Additionally, it is desirable to be able to adjust the currents in the correction coils from time to time to compensate for changes in the uniformity of the magnetic field as a result of changes in the position of external ferromagnetic objects. In a typical magnet, the main magnet coils typically carry a current of approximately 1,000 amperes while the correction coil currents are typically no more than approximately 50 amperes.

While the correction coils and the main magnet coils typically comprise superconductive material, circuit energization is generally accomplished by means of normal (that is, resistive) conductors which penetrate the nested set of cryostat vessels without significantly impairing their insulating function or increasing the rate of helium evaporation. Since it is desirable to make electrical connections to the interior of the cryostat retractable in the sense that they can be removed from the cryostat vessel, several significant criteria must be met. Firstly, it must be noted that, because of the extremely low temperatures at which the electrical contact is made, there is a very strong tendency for frost to form on the electrical contacts. This frost typically includes both ice and a frost of solidified air itself. This frost, whether ice, air or both, can significantly impede the formation of a good electrical connection between the interior cryostat circuit and an exterior energizing source. Additionally, it is also significant to note that the electrical and mechanical properties of the contact surfaces must be adequate at the cryogenic temperatures employed. In particular, the hardness and electrical conductivities of the contacts employed must be such that good electrical contact is made and maintained even at low temperatures. Satisfactory electrical contact is important because a high resistivity contact junction will result in the generation of heat in accordance with the formula $I^2R$, where I is the current and R is the contact electrical resistance. Again, it should be borne in mind that currents of approximately 1,000 and 50 amperes typically flow in such circuits so that even slight increases in electrical resistance can produce high levels of thermal energy which deleteriously act to unnecessarily boil off cryogenic coolants such as liquid helium which is relatively expensive. Thirdly, since the lead is desired to be retractable, it is necessary to provide a mechanism in which excessive wear, erosion and abrasion of the contact surfaces does not occur. This latter criteria helps to insure consistency of device performance and magnetic field strength uniformity. In sum, electrical contacts that are normally used at ambient temperature conditions are not suitable for low temperature applications because the hardness of the mating surfaces is increased and frost accumulation will develop on the contact surfaces. Consequently, electrical contacts which exhibit a low resistance at ambient temperatures have considerably higher resistance at cryogenic temperatures. This is of particular concern in those situations in which high current levels can produce ohmic heating at the contact surface and can therefore result in excessive cryogen consumption. All of these factors are complicated by the fact that the contact surface typically lies deep within the interior of the cryostat structure and by the fact that material properties such as hardness and resistivity are highly temperature dependent. Accordingly, it is seen that an electrical contact mechanism and lead assembly is required to overcome these problems.

SUMMARY OF THE INVENTION

In accordance with a preferred embodiment of the present invention an electrical contact clamp for operation at cryogenic temperatures includes a metal ring having a gap in its periphery. The ring is attached to a mounting block with the point of attachment being near to one side of the gap. A pivoting cam lever is disposed so that pivoting motion of the lever urges the cam end of the lever against the gapped ring so as to tend to close the gap. The interior surface of the split ring is serrated to provide a firm grip against a cylindrical conductor which is disposed within the ring. The mating conductor preferably includes a contact surface which has disposed thereon a metal coating that is relatively soft with respect to the ring metal at cryogenic temperatures. This arrangement permits the clamp to bite into the conductor. The cam levers are preferably manipulated by means of a special tool so that the cam levers do not have to extend beyond the outer cryostat wall. In a preferred embodiment of the present invention the conductive metal ring and mounting block comprise an integral copper structure with the serrated surface of the ring being coated with a low resistivity metal such as silver. The mounting block preferably also includes an axle about which the pivoting cam lever can pivot. The cam lever itself preferably comprises a durable non-magnetic alloy such as beryllium-copper or a titanium alloy. A beryllium-copper or titanium alloy push block is also preferably disposed between the split ring and the cam lever. The conductor which the clamp of the present invention grips also preferably includes a coating of a metal such as indium because of its ability to maintain its relative softness at cryogenic temperatures.

Accordingly, it is an object of the present invention to provide effective and reliable electrical contact means to energize superconductive electrical circuits disposed within a cryostat structure.

It is another object of the present invention to provide a mechanism for overcoming the problem of ice and frost buildup on electrical contacts maintained at cryogenic temperatures.

It is also an object of the present invention to provide an electromechanical structure which may be readily accessed from the exterior of the cryostat in which it is disposed.

Lastly, but not limited hereto, it is an object of the present invention to provide an insulated retractable lead system for NMR magnets.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
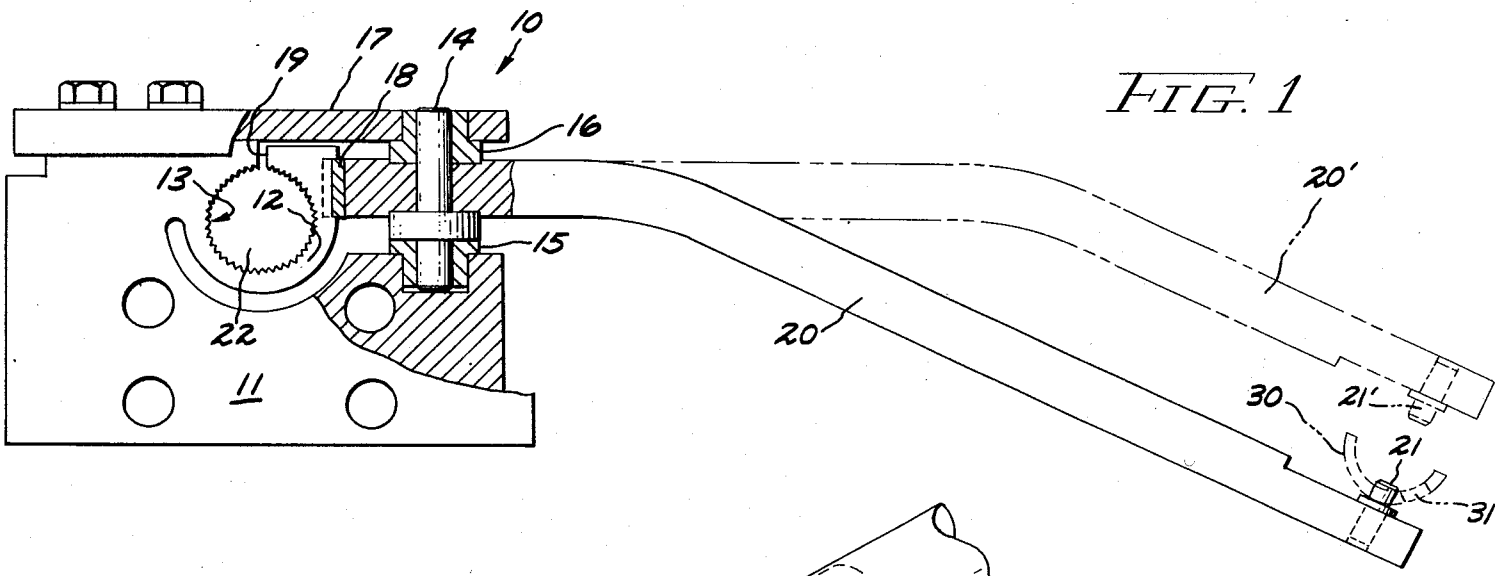
FIG. 1 is a partially cross-sectional side elevation view illustrating the clamp of the present invention.

The essential features of the present invention are best shown in FIG. 1. Split ring 12 with gap 19 possesses interior serrated surface 13 which grips and makes firm electrical contact with electrical conductors disposed within circular opening 22. It is noted that while the description herein and the appended claims describe the opening as circular for the purpose of accommodating cylindrical conductors, that it is intended that any other conveniently shaped electrical conductor and opening may be employed. Ring 12 is bias in a normally open position. However, pivoting cam lever 20, in pivoting about axle 14, urges one end of split ring 12 in a direction so as to tend to close gap 19. The apparatus shown in FIG. 1 also preferably includes push block 18 comprising a hard, wear-resistant, non-magnetic material such as beryllium-copper or a titanium alloy. Push block 18, comprises a small U-shaped member which acts to cut down wear and abrasion so as to make the clamp of the present invention long lived. This is desirable because the clamp is disposed in a relatively inaccessible position within the cryostat.

Although not visible in FIG. 1, the end of cam lever 20 adjacent to push block 18 is rounded so as to provide the desired cam action. Axle 14 is disposed within bushings 15 and 16, which are in turn disposed within mounting block 11 and capping plate 17 respectively. Capping plate 17 acts to hold the clamp assembly together. Bushings 15 and 16 preferably comprise a soft bearing material such as brass. Capping plate 17 is affixed, as by bolting or any other convenient means, to mounting block 11. Split ring 12 is also affixed to mounting block 11. Split ring 12 is attached block 11 at a position relatively near to one side of gap 19 so as to provide a large amount of flexibility in the motion of ring 12 as cam lever 20 is pivoted about axle 14.

The interior of ring 12 is provided with serrated surface 13. As shown, the serrations run in a direction out of the plane of the ring. However, it is equally possible to employ a split ring having a circumferentially serrated interior surface. The serrations are employed so that ring 12 of clamp 10 can readily dig into the contact surface of a mating conductor. In order to apply the desired degree of electrical conductivity, serrated inner surface 13 is also preferably coated with a metal having a lower electrical resistivity than ring 12 itself. Silver or gold is preferentially employed for this purpose. It must be kept in mind that the proper operation of clamp 10 in the present invention is significantly dependent upon the materials chosen in its construction. This is because these materials are employed at cryogenic temperatures, such as approximately 4° K., for example. Accordingly, it is necessary that the materials employed exhibit the desired electrical and mechanical properties, particularly hardness and low resistivity. Furthermore, the materials chosen must be compatible with one another at these temperatures, particularly with reference to thermal expansion coefficients. Accordingly, to prevent abrasion and wear, as described above, cam lever 20, lever axle 14, and push block 18 are made of hard, wear resistant, preferably non-magnetic materials. For example, beryllium-copper or titanium alloys are readily employable for this purpose. Bushings 15 and 16, may for example comprise brass. Mounting block 11 together with split ring 12 preferably comprise an electrically conductive material such as copper. Furthermore, split ring 12 and mounting block 11 are preferably fashioned from a single integral structure as shown.

Figure 4:
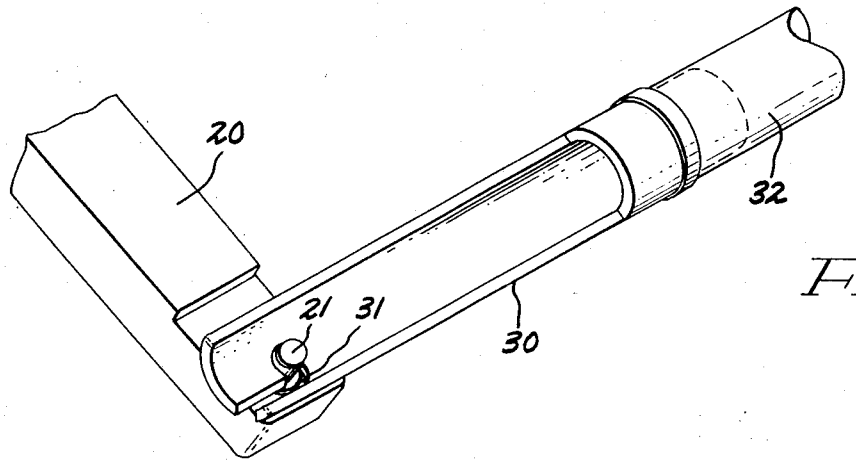
FIG. 4 is an isometric view illustrating the use of a special tool for manipulation of the cam levers from positions exterior to the outer cryostat vessel wall.
Figure 5:
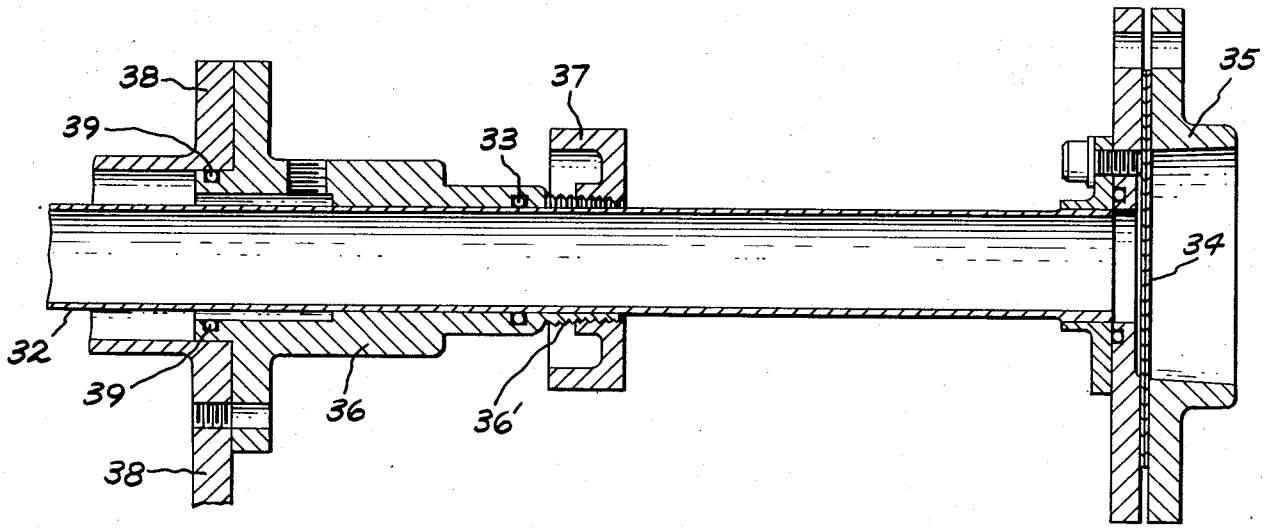
FIG. 5 is a cross-sectional side elevation view illustrating the exterior end of the tool of FIG. 4 as it is disposed through the outer cryostat wall for manipulation of the cam levers.

In the present invention, the electrical conductors which are inserted into opening 22 in split ring 12 typically carry currents of 1,000 amperes. Since a return electrical path is required, two such clamps as shown in FIG. 1, are generally employed, one being mounted in line directly behind the other. However, the second clamp is preferably selected to include a cam lever 20' having a somewhat different shape. Accordingly, in FIG. 1 there is also shown, in phantom view, the cam lever arm 20' of the clamp in accordance with the present invention which is mounted directly behind the clamp shown. The end of each cam lever arm 20 and 20' includes pin 21 and 21', respectively. A special tool 30 as described in FIGS. 4 and 5 is provided with keyway 31 to engage either pin 21 or 21' and to thereby effectuate movement of the cam lever arm 20 or 20' about axle 14.

Figure 2:
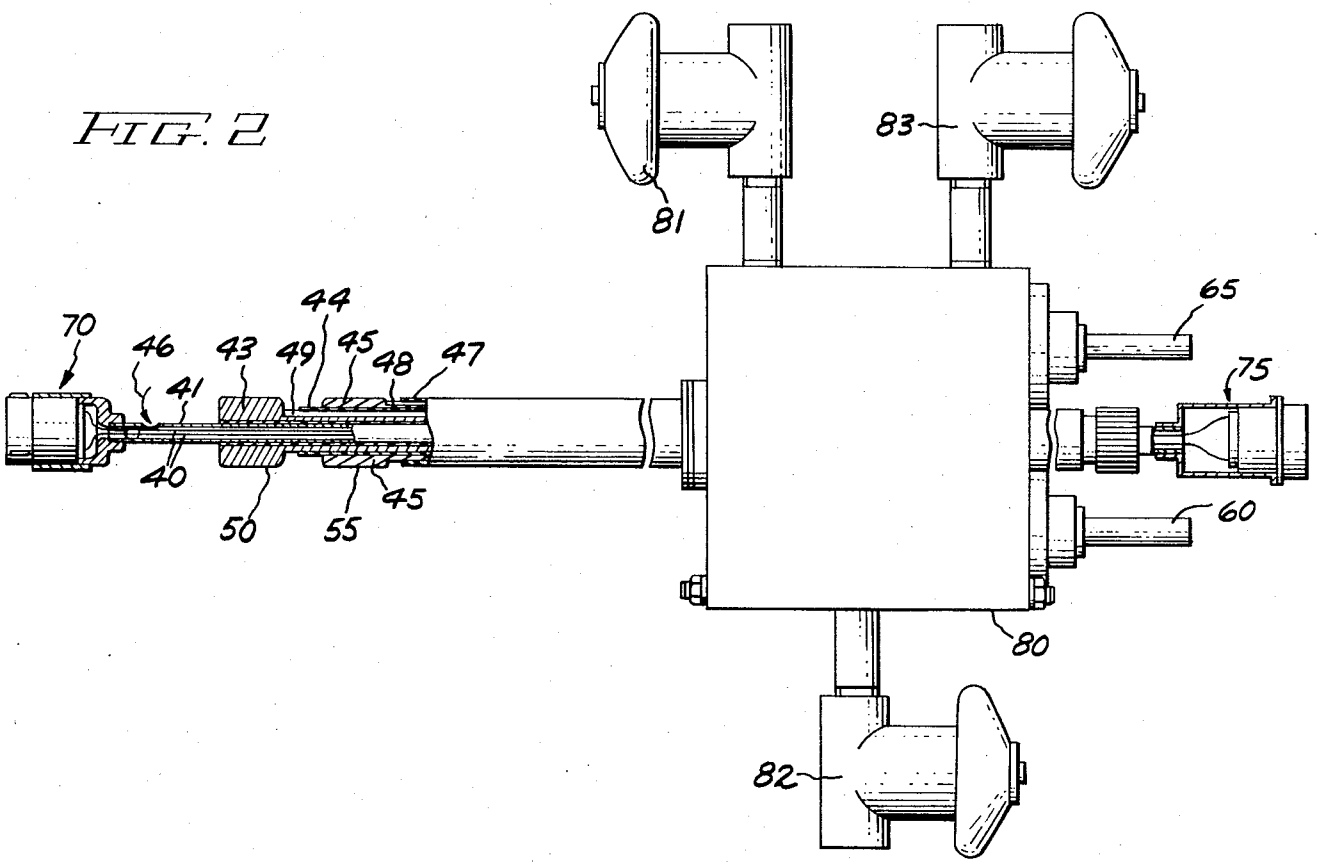
FIG. 2 is a partially cross-sectional side elevation view illustrating the conductor which is disposed within the clamp shown in FIG. 1.
Figure 3:
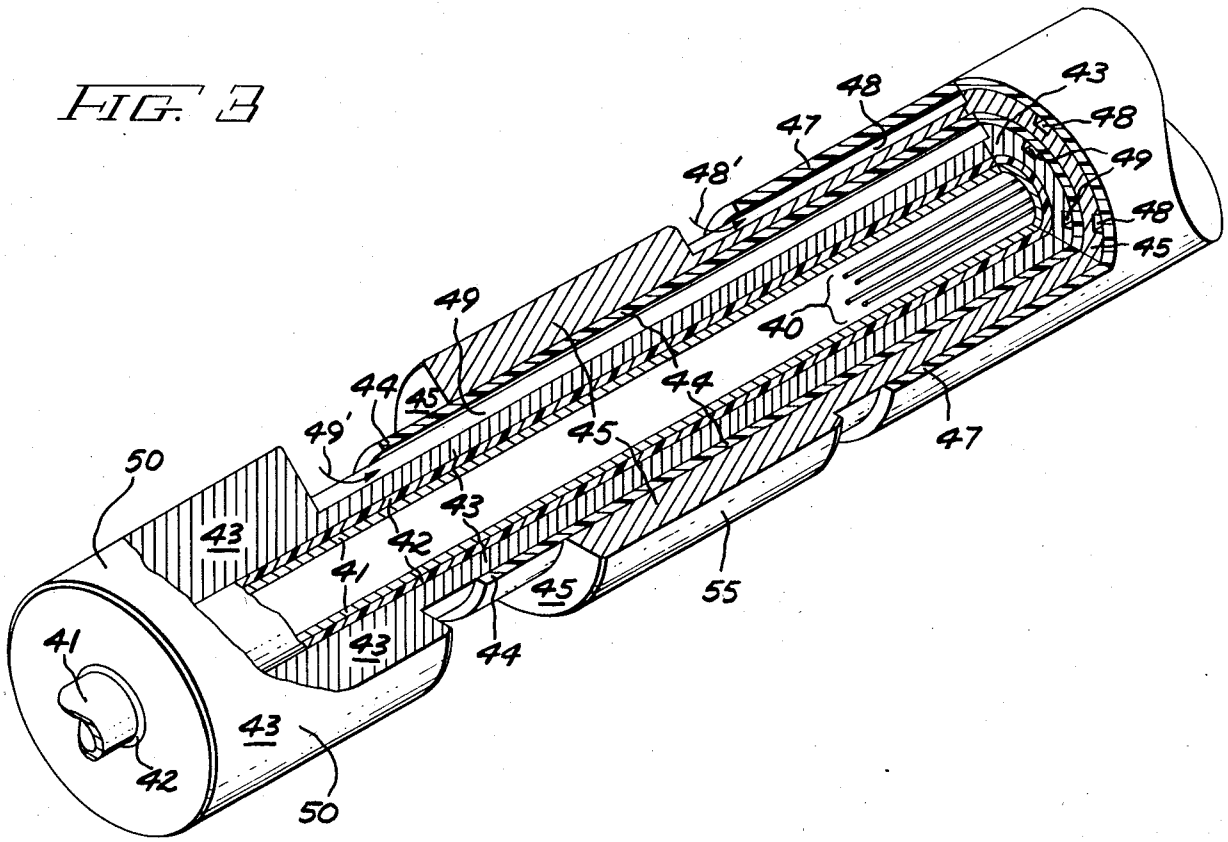
FIG. 3 is a partially cross-sectional isometric view of one end of the lead assembly shown in FIG. 2.

While most of the elements of the present invention are shown in FIG. 1, attention is now directed to FIGS. 2 and 3 and consideration of the electrical conductors which are inserted into clamps 10. In normal operation, the serrated surfaces of the clamps are moved into a friction fit with surfaces 50 and 55 of conductors 43 and 45, respectively. Each surface 50 and 55 is made to contact the inner serrated surface 13 of a distinct clamp by means of pivoting the cam levers 20 and 20' about their respective axles. This pivoting is effectuated by means of special tool 30, more particularly described below in reference to FIGS. 4 and 5.

The structure shown in FIG. 2 is essentially described from the inside out. More particularly, it is seen that centrally located electrical conductors 40 are disposed centrally within tube 41 preferably comprising stainless steel. Conductors 40 extend from exterior connector 75 to interior connector 70. Connector 70 is preferably provided with alignment pins to facilitate the connection. It is to be kept in mind that the entire assembly shown in FIG. 2 is removable and functions to provide not only electrical connection to interior cryostat components, but also functions to minimize heat loss and to provide vapor cooling of the penetration components. Electrical conductors 40 between plugs 75 and 70 typically are provided to energize correction coil circuits. However, the main magnet coils are energized partly by means of electrically conductive lead 43 which is connected to lead 60 through airtight connection box 80. Conductor 43 possesses surface 50 which is preferably coated with an electrically conductive material which is soft at cryogenic temperatures, particularly with respect to the material employed in split ring 12. Electrical conductor 43 preferably comprises an elongate copper tube with grooves 49 disposed therein. These grooves along with grooves 48 described below, provide a helium vapor flowpath through the retractable lead assembly shown extending from the left side of box 80. These channels provide vapor cooling of the power leads. The flow of helium vapor through the main coil power leads is independently controlled by means of valves 81 and 82.

A second main electrical conductor 45, also preferably having indium coated contact surface 55, is disposed coaxially about lead 43. However, leads 43 and 45 are insulated from one another by means of MYLAR® sheath 44. This sheath, together with outer MYLAR® sheath 47, also help to define coolant channels 48 and 49. The flow of helium vapor in these channels is better illustrated in FIG. 3 below. It should also be noted that tube 41 is also provided with an insulating layer 42 (see FIG. 3).

The correction coil power leads 40 typically comprise wires insulated with FORMVAR® insulation and are disposed within central stainless steel tube 41. These wires are cooled by forced flow of helium, controlled by valve 83. Each end of the leads 40 is soldered to a lead in a conventional 32 pin connector. However, because of the small current rating for these leads, resistance heating at the low temperature connector contacts is acceptable despite the relatively high contact resistance.

A more detailed end view of the retractable lead shown in FIG. 2 is provided in FIG. 3. In particular, the arrangement, configuration and location of helium flow channels 48 and 49 are more readily visible. Furthermore, flow arrows 48' and 49' indicate the direction of flow of helium vapor through channels 48 and 49, respectively. However, of greatest importance in understanding the use and construction of the present invention, it should be noted that surfaces 50 and 55 are coated with a metal conductor such as indium. The coating for these surfaces is selected to be one which exhibits low electrical contact resistance and yet is relatively soft at cryogenic temperatures. In operation, each of these surfaces is disposed through a clamp such as clamp 10 shown in FIG. 1. The serrations on the interior of the clamp ring bite into the relatively softer coating on surfaces 50 and 55 to effect the desired degree of low resistivity electrical connection. This low resistivity connection is made in spite of the formation of water or even air frost on the mating surfaces. Furthermore, since there is no force applied against the surfaces during insertion and retraction of the cryostat penetration assembly, there is minimal wear on the surfaces involved. Accordingly, it is seen that the structure provided is capable of repeated utilization without significant wear.

Since, the clamp of the present invention is disposed in a relatively inaccessible position within the interior of the cryostat, external means must be provided to actuate the cam levers. As described above, each cam lever is provided with a pin (21 or 21'). A special tool 30 having a notched L-shaped keyway 31 is made to engage the pin and to thereby effectuate pivotal motion of cam lever 20 or 20' about its corresponding axle. In this way, gap 19 is closed as the cam levers push against one side of the split ring the other side of which is affixed to block 11. Tool 30 preferably comprising a material such as brass is essentially half-cylindrical in shape. This configuration permits tool 30 to be rotated about its longitudinal axis so as to be able to engage both pins 21 and 21' (see FIG. 1) through the sames access aperture.

However, since tool 30 is to be employed in a manner in which it extends through a cryostat wall, a somewhat more elaborate implement than that shown in FIG. 4 is required. In particular, attention is directed to FIG. 5. In FIG. 4 it is seen that tool 30 is disposed and brazed within hollow, conduit 32 preferably comprising stainless steel. Conduit 32 extends through cryostat wall 38 and mounting flange 36 and is sealed therein by means of O-ring 39. Conduit 32 is slidable within flange 36 and can therefore be maneuvered to engage pins 21 or 21' as described above. In particular, if one or the other of these two pins is to be engaged, tool 30 is rotated through an angle of 180° and axially repositioned to engage the pin desired.

Mounting flange 36 includes tapered slotted nipple 36'. Tightening flange 37 is turned on nipple 36' to lock tube 32 in position. Tube 32 also preferably includes ejectable thermal insulation means (not shown) disposed therein. O-ring 33 also seals tube 32 in flange 36. Furthermore, conduit 32 in which tool 30 is disposed includes a sealing flange 35 which contains rupture disk 34 to provide pressure relief against overpressure conditions that could result, for example, from magnet quench or cryostat vacuum loss. Any thermal insulation material in tube 32 is then ejected.

From the above, it is seen that the clamp and electrical lead assembly of the present invention provide a reliable mechanism for providing electrical contact between leads at low temperature conditions. It is furthermore seen that the apparatus of the present invention may be employed repeatedly without significant contact degradation. It is also seen herein that the present apparatus facilitates utilization of retractable leads in the construction of superconducting magnets, particularly those used in NMR medical diagnostic imaging. It is also seen that the present invention provides a tool which is readily insertable into a cryostat to engage the clamp mechanism of the present invention. Furthermore, even though the materials desired for use in the present invention must meet a stringent set of requirements with respect to conductivity, hardness and compatability at low temperatures, the apparatus of the present invention is nonetheless readily fabricatable at a relatively low cost.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. An electrical contact clamp for operation at cryogenic temperatures, said clamp comprising:

a conductive metal ring having a gap in its periphery, the radially inner portion of said ring having a serrated surface;

a mounting block to which said split ring is attached, said point of attachment being proximal to one side of said gap;

a pivoting cam lever disposed so that the pivoting motion of said lever urges the cam of said lever against said gapped ring so as to tend to close said gap; and a push block disposed between said ring and said cam lever.

2. The clamp of claim 1 in which said push block comprises a metal selected from the group consisting of beryllium-copper, and a titanium alloy.

3. The clamp of claim 1 in which said ring metal comprises copper.

4. The clamp of claim 1 in which said pivoting cam lever comprises metal selected from the group consisting of beryllium-copper, and titanium alloys.

5. The clamp of claim 1 in which said serrated surface is plated with a metal having lower electrical resistivity than said ring metal.

6. The clamp of claim 5 in which said serrated surface is plated with silver.

7. The clamp of claim 1 in which said metal ring and said mounting block form an integral structure.

8. The clamp of claim 7 in which said ring and said mounting block comprise copper.

9. The clamp of claim 7 further including a pivot for said cam lever, said pivot being mounted within said block.

10. The clamp of claim 9 in which said pivot comprises material selected from the group consisting of beryllium-copper or titanium alloy.

11. An electrical lead assembly for operation at cryogenic temperatures, said assembly comprising:

a conductive metal ring having a gap in its periphery, the radially inner portion of said ring having a serrated surface;

a mounting block to which said split ring is attached, said point of attachment being proximal to one side of said gap;

a pivoting cam lever disposed so that the pivoting motion of said lever urges the cam end of said lever against said gapped ring so as to tend to close said gap; and a cylindrical conductor disposed within said ring, the surface of said cylindrical conductor having an electrically conductive metal coating that is relatively soft with respect to the material of said metal ring at cryogenic temperatures.

12. The lead assembly of claim 11 in which said coating on said cylindrical conductor comprises indium.

13. An electrical clamp assembly for operation at cryogenic temperatures, said assembly comprising:

a conductive metal ring having a gap in its periphery, the radially inner portion of said ring having a serrated surface;

a mounting block to which said split ring is attached, said point of attachment being proximal to one side of said gap;

a pivoting cam lever disposed so that the pivoting motion of said lever urges the cam of said lever against said gapped ring so as to tend to close said gap;

a tool member with means for selectively interlocking with said cam lever at one end thereof, said tool member having rupture disk means disposed at the opposite, outer end thereof;

a tubular penetration member; and flange means attached to said tool member for sealing against said penetration tube and against a vessel wall.

14. The clamp assembly of claim 13 in which said tool member comprises brass.

15. The clamp assembly of claim 13 in which said penetration member comprises stainless steel.

16. The clamp assembly of claim 13 in which said tool member is hollow and half cylindrical in shape.

* * * * *